US005706019A

United States Patent [19]

Darden, IV et al.

[11] Patent Number: 5,706,019

[45] Date of Patent: Jan. 6, 1998

[54] INTEGRAL ANTENNA ASSEMBLY FOR A RADIO AND METHOD OF MANUFACTURING

[75] Inventors: William Herbert Darden, IV, Libertyville, Ill.; Kevin Michael Thill, Kenosha, Wis.

[73] Assignee: Motorola, Inc., Schaumburg, Ill.

[21] Appl. No.: 668,020

[22] Filed: Jun. 19, 1996

[51] Int. Cl.[6] ..... H01Q 1/36

[52] U.S. Cl. ..... 343/895; 343/702

[58] Field of Search ..... 343/702, 745, 343/749, 865; H01Q 1/36

[56] References Cited

U.S. PATENT DOCUMENTS

| | | | |
|---|---|---|---|
| 3,599,220 | 8/1971 | Dempsey | 343/895 |
| 3,945,014 | 3/1976 | Kunert et al. | 313/713 |
| 3,946,397 | 3/1976 | Irwin | 343/788 |
| 4,238,800 | 12/1980 | Newington | 343/715 |
| 5,014,346 | 5/1991 | Phillips et al. | 455/89 |
| 5,191,352 | 3/1993 | Branson | 343/895 |
| 5,346,300 | 9/1994 | Yamamoto et al. | 343/895 |
| 5,349,365 | 9/1994 | Ow et al. | 343/895 |
| 5,612,707 | 3/1997 | Vaughan et al. | 343/895 |

*Primary Examiner*—Donald T. Hajec
*Assistant Examiner*—Tho Phan
*Attorney, Agent, or Firm*—Daniel W. Juffernbruch

[57] ABSTRACT

Strips (220) of thin metallic material forming pairs of arms on an elongated dielectric tube (110) form a radiator portion of an antenna assembly. A first radiator plate (310) and a second radiator plate (320) are capacitively coupled to respective hot capacitive plate (270) and ground capacitive plate (280) on opposite sides of the dielectric tube and formed in a single etching step to improve manufacturability, reliability and cost of a radio.

20 Claims, 5 Drawing Sheets

INTEGRAL ANTENNA ASSEMBLY FOR A RADIO AND METHOD OF MANUFACTURING

BACKGROUND OF THE INVENTION

1. Technical Field of the Invention

The present invention relates to antenna assemblies and, more particularly, relates to antenna assemblies with capacitors integrally formed therein.

2. Description of the Related Art

Antennas for small or portable land-based satellite radios require high gain and a hemispherical radiation pattern. For example, a quadrifilar helix antenna has two pairs of arms forming looped antenna elements and providing high gain and a hemispherical radiation pattern. In the quadrifilar antenna, the looped antenna elements are crossed orthogonally.

These antenna elements often employ an impedance transformation network for matching to the impedance of an associated radio transceiver. A capacitor alone, or together with other impedance altering components, can be used in such a transformation network. It has been found most efficient to locate an impedance transformation network in the same assembly as the antenna element. However, locating the impedance transformation network in the same assembly as the antenna element increases costs and complexity of the assembly. An antenna assembly employing an impedance transformation network with a small number of parts and simple manufacture is desired to improve manufacturability, reliability and cost.

DETAILED DESCRIPTION OF THE PREFERRED EMBODIMENTS

Figure 1:
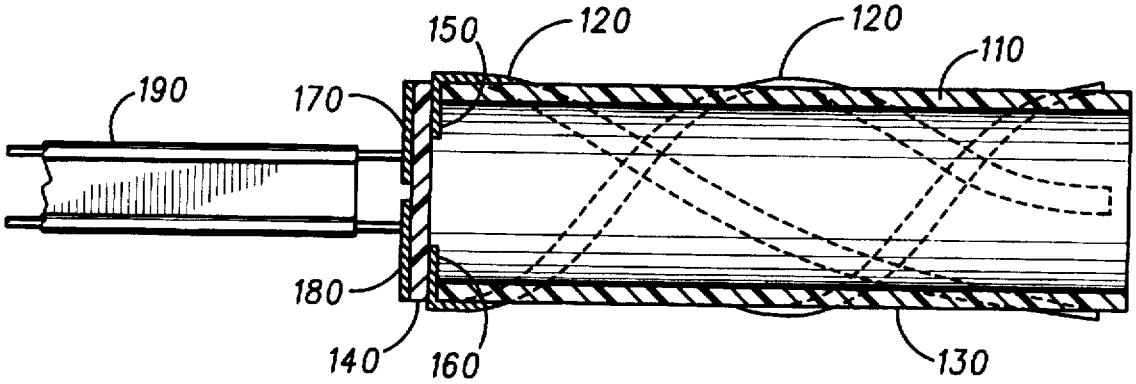
FIG. 1 illustrates a side view of an integral antenna assembly according to a first approach.

FIG. 1 illustrates a side view of an integral antenna assembly according to a first approach with a capacitive impedance transformation network located in the same assembly as the antenna element. An elongated dielectric tube 110 has four strips of thin metallic material formed thereon providing arms of the antenna element. Two pairs of the arms form orthogonal loops which are preferably twisted around the dielectric tube 110, thereby forming a circularly-polarized, quadrifilar helix antenna element on a surface 130 of the elongated dielectric tube 110. A crossed loop antenna element can be instead formed if the arms are not twisted around the dielectric tube 110.

First and second plates 150 and 160 oppose respective hot and ground plates 170 and 180. The first and second plates 150 and 160 respectively connect to a corresponding pair of strips 120 of thin metallic material. The hot and ground plates 170 and 180 respectively connect to hot and ground leads of a balanced feedline 190.

A three-dimensional etching to form the strips 120 of thin metallic material on the dielectric tube 110 is performed for the radiating elements and a two-dimensional etch on the dielectric disk 140 is performed to form the plates 150, 160, 170 and 180. Thereafter, the plates 150 and 160 are soldered to corresponding pairs of strips 120. This structure forms a compact assembly having two piece parts and four solder joints, one joint between each of the first and second plates 150 and 160 and a corresponding pair of strips 120. Nevertheless, a further reduced number of parts and solder joints is desired. Elimination of different etching steps and any unnecessary soldering steps further improves manufacturability, reliability and cost.

Figure 2:
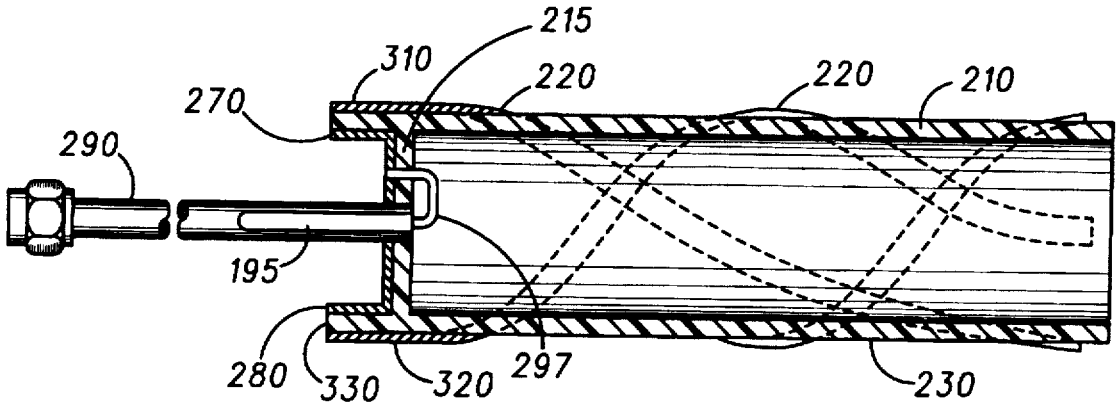
FIG. 2 illustrates a side view of an integral antenna assembly according to a first embodiment of a second approach.
Figure 3:
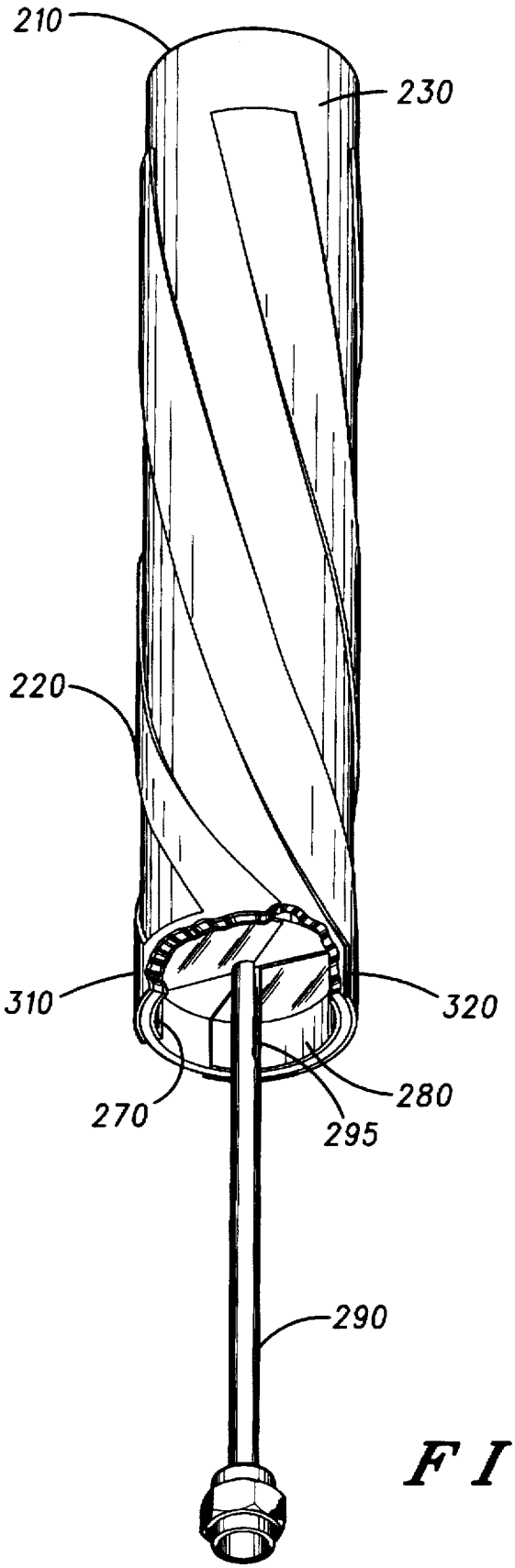
FIG. 3 illustrates a perspective view of an integral antenna assembly according to the first embodiment of the second approach.

FIGS. 2 and 3 respectively illustrate a side view and a perspective view of an integral antenna assembly according to a first embodiment of a second approach having less manufacturing steps and components than the first approach of FIG. 1. Specifically, the four solder joints and the second piece part of the first approach of FIG. 1 are eliminated. A single three-dimensional etch is the only etching required according to this second approach. Furthermore, the four solder joints are eliminated by forming the plates and strips from the same material in the same etching step thereby producing an integrally-formed antenna assembly.

Strips 220 of thin metallic material are formed from the same metal as a first radiator plate portion 310 and a second radiator plate portion 320 on the surface 230 of the elongated dielectric tube 210. The hot and ground capacitive plates 270 and 280 are also formed of the thin metallic material disposed on a side of the elongated dielectric tube opposite the first and second radiator plate portions 310 and 320. The elongated dielectric tube forms a flange 330 between the plates. Hot and ground leads of a feedline 290 respectively connect to the hot and ground capacitive plates 270 and 280. These two connections are the only solder joints necessary for this antenna assembly. By forming the hot and ground capacitive plates 270 and 280 on an inside surface of the dielectric tube 210 near a feed end, the same three-dimensional etching process which forms the strips 220 and radiator plate portions 310 and 320 will also form the hot and ground capacitive plates 270 and 280 in one etching operation. Formation of both plates of a matching capacitor and radiating arms of an antenna assembly would heretofore would not have been achieved to yield the integral assembly having improved manufacturability, reliability and cost.

The feedline 290 in FIGS. 2 and 3 is unbalanced and preferably includes a split sheath 295 on an outer lead thereof near the feed end forming a split-sheath balun (balanced-unbalanced network). The split sheath 295, together with the capacitors formed by plates 310, 320, 270 and 280, provides the impedance transformation network. A center lead 297 of the feedline 290 at the feed end is soldered to one side of the outer lead of the feedline 290 and to the hot capacitive plate 270. The other side of the outer lead of the feedline 290 is soldered to the ground capacitive plate 280. Thus, the structure of the present invention conveniently locates a balun within the integrally-formed antenna assembly. Nevertheless, the split-sheath balun can be replaced by other balun types or can be eliminated with capacitors still employed for impedance matching.

The feed end of the elongated dielectric tube 210 is preferably closed by an inner-wall portion 215. The inner-wall portion 215 in the first embodiment of the second approach preferably provides mechanical support for the feedline 290 and secondarily provides a surface for metalization paths electrically connecting the feedline 290 to the hot and ground capacitive plates 270 and 280. The elongated dielectric tube 210 although preferably cylindrically-shaped with a round cross-section can alternatively be rectangular in shape having a square cross-section or other shape yielding an oval, rectangular or other cross-section.

The capacitor formed by the first and second radiator plate portions 310 and 320 and the hot and ground capacitive plates 270 and 280 is principally disposed to match impedance of the feedline 290 to the arms 220 of the radiating structure. The required capacitance for matching depends on other characteristics of the antenna structure such as the dielectric constant of the elongated dielectric tube 210, a width of the elongated dielectric tube, a thickness of the elongated dielectric tube, the lengths of the arms formed by the strips 220, an area of the first and second radiator plate portions 310 and 320 and an area of the hot and ground capacitive plates 270 and 280. The arms of the antenna have lengths along the curve of about 103.6 millimeters (4.08 inches) for a preferred 1.621 GigaHertz (GHz) nominal resonant frequency. The elongated dielectric tube 210 thus has a preferred length of about 114.3 millimeters (4.50 inches) and a preferred width of about 17.52 millimeters (0.690 inches). With a preferred thickness of the elongated dielectric tube of about 1.22 millimeters (0.048 inches), the first and second radiator plate portion preferably each have an area of about 115.48 square millimeters (0.179 square inches) and the hot and ground capacitive plates each have a preferred area of about 99.35 square millimeters (0.154 square inches) in the first embodiment of FIGS. 2 and 3. Should the diameter of the dielectric tube 210 decrease, the capacitance must be increased by increasing the area of the plates, by decreasing the separation between the plates or by increasing the dielectric constant of the dielectric material. Should the nominal resonant frequency increase, the lengths of the arms should decrease and the capacitance must be decreased by decreasing the area of the plates, by increasing the separation between the plates or by decreasing the dielectric constant of the dielectric material. Nevertheless, the plate size also increases as the thickness of the dielectric increases. The dielectric material is preferably made of a polyetherimide plastic material having a dielectric constant of approximately 3.15 and the thin metallic strips are preferably made of copper glued to the dielectric material prior to etching.

Figure 4:
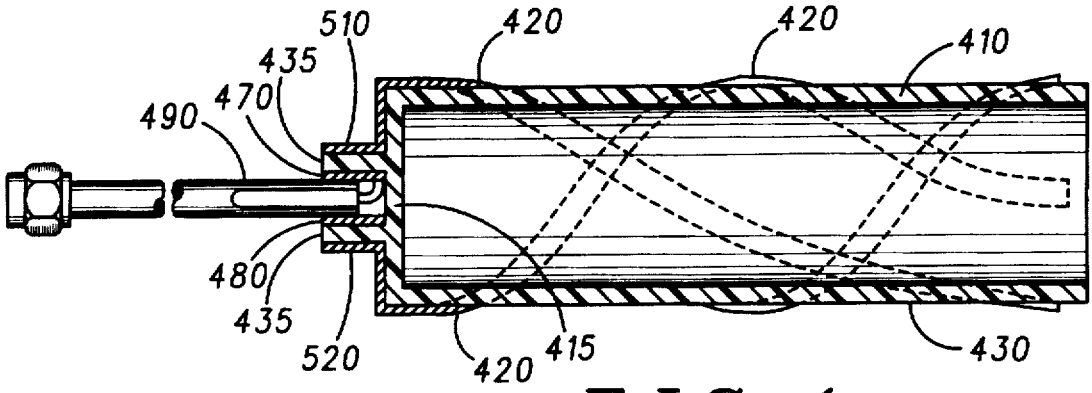
FIG. 4 illustrates a side view of an integral antenna assembly according to a second embodiment of the second approach.

FIG. 4 illustrates a side view of an integral antenna assembly according to a second embodiment of the second approach. In the second embodiment, the surface 430 of the elongated dielectric tube 410 comprises a flange 435 protruding from a feed end of the surface 430. First and second radiator plate portions 510 and 520 are formed on a first side of the flange 435 and electrically-connected to arms 420. The first and second radiator plate portions 510 and 520 and the arms 420 are preferably of the same metallic material formed by etching in one step. Hot and ground capacitive plates 470 and 480 are thus formed on the second side of the flange 435. The hot and ground capacitive plates 470 and 480 can thus capacitively couple to the first and second radiator plate portions 510 and 520 on opposing sides of the flange, wherein the first and second radiator plates and hot and ground capacitive plates can be formed in a single etching step thus improving reliability, manufacturability, and cost.

The flange 435 can form a concentric skirt or ring protruding from a feed end of the surface 430. The concentric skirt or ring thus preferably would have a diameter concentric with an outer diameter of a feedline 490. Thus, the feedline 490 can be press-fit into the concentric skirt or ring for mechanical integrity and efficient electrical connection therebetween. When press-fit, the two split-sheath outer leads can serve as the hot and ground capacitive plates themselves. Although electrical connection can be achieved by press-fitting, a solder joint is preferred for improved reliability.

Figure 5:
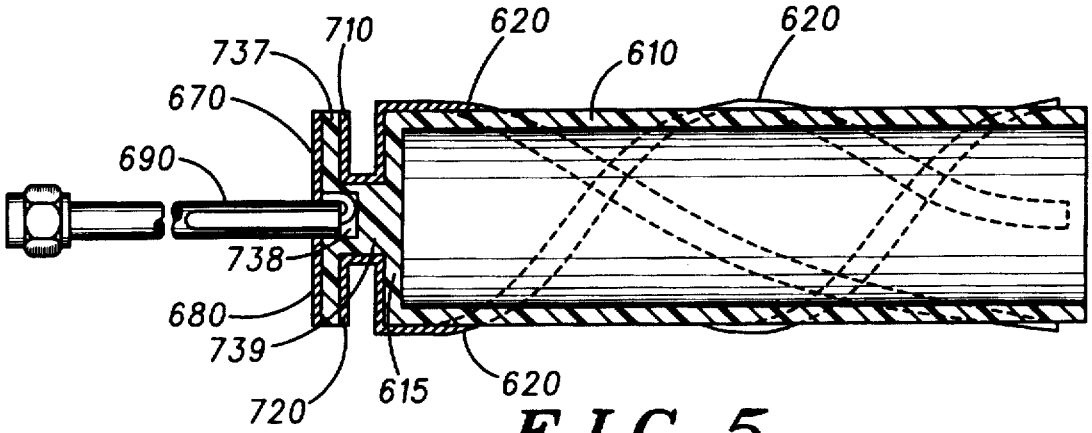
FIG. 5 illustrates a side view of an integral antenna assembly according to a third embodiment of the second approach.

FIG. 5 illustrates a side view of an integral antenna assembly according to a third embodiment of the second approach. A pad 737 is suspended from an inner-wall 615 at the feed end of an elongated dielectric tube 610 by a stem 739. The pad 737 is preferably shaped as a disc and concentrically-suspended by the stem 739 at an axial center of a cylindrically-shaped tube 610. First and second radiator plate portions 710 and 720 are formed on the first side of the pad 737 and hot and ground capacitive plates 670 and 680 are formed on a second side of the pad 737. The first and second radiator plate portions 710 and 720 are electrically coupled to the strips 620 of the arms as in the first or second embodiment of FIGS. 2 or 4 by a single etching step. A hole 738 in the pad 737 for mechanically securing the feedline 690 is preferably formed as illustrated in FIG. 5.

Figure 6:
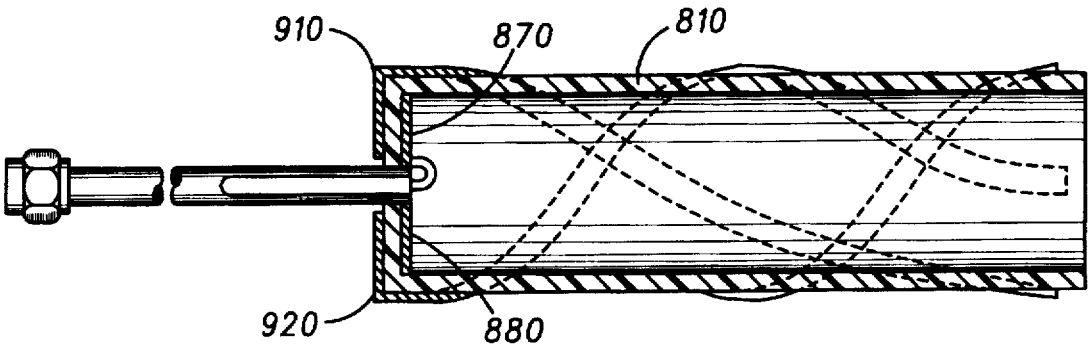
FIG. 6 illustrates a side view of an integral antenna assembly according to a fourth embodiment of the second approach.

FIG. 6 illustrates a side view of an integral antenna assembly according to a fourth embodiment of the second approach. In the fourth embodiment, the hot and ground capacitive plates 870 and 880 are formed deep on an inside surface of the elongated dielectric tube 810, while the first and second radiator plate portions 910 and 920 are formed on an outside surface of the elongated dielectric tube 810 in one step on both an inside and an outside surface at the same time. The feed end of the tube can be left open to achieve easier etching.

Figure 7:
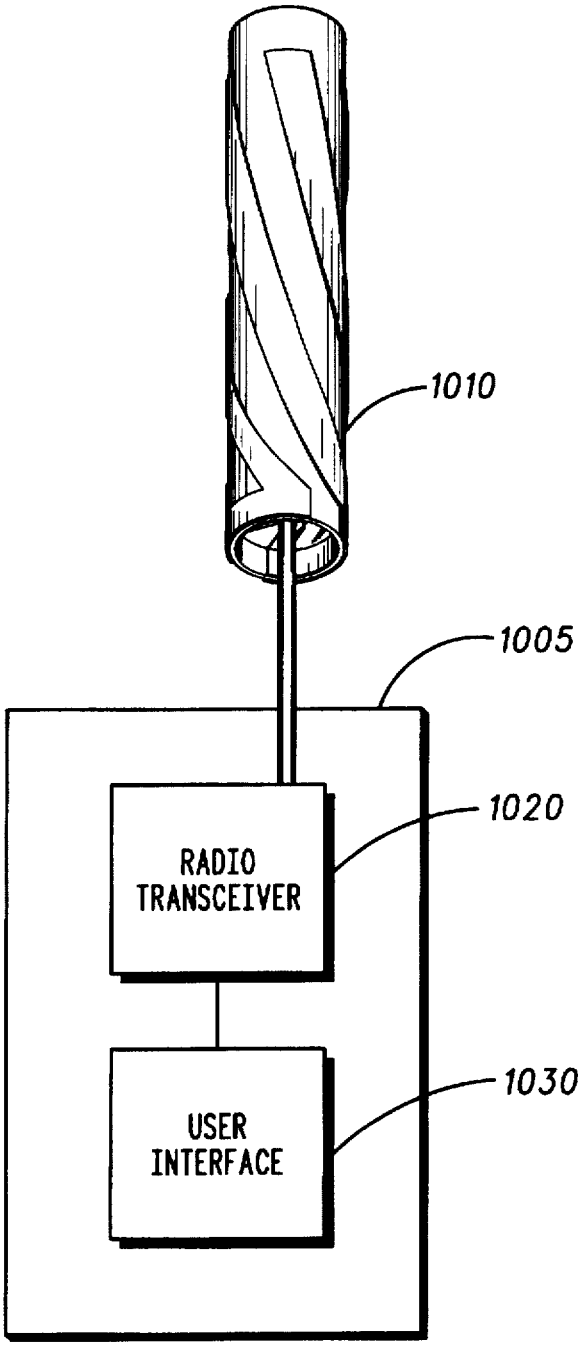
FIG. 7 illustrates a perspective view of a radiotelephone having a radio transceiver, user interface, and antenna assembly.

FIG. 7 illustrates a portable radio according to the present invention. A portable radio 1005, preferably a radiotelephone, contains a radio transceiver 1020 connected to a user interface 1030. The user interface provides a speaker, earphone, and control, such as keypad and/or display for the user. The user interface 1030 controls operation of the radio transceiver 1020 and provide transducers for the sound for voice communications. The radio transceiver 1020, in the case of a radiotelephone, contains both transmitter and receiver connected via duplexer to both the hot and ground lines of a feedline of the antenna assembly 1010.

Figure 8:
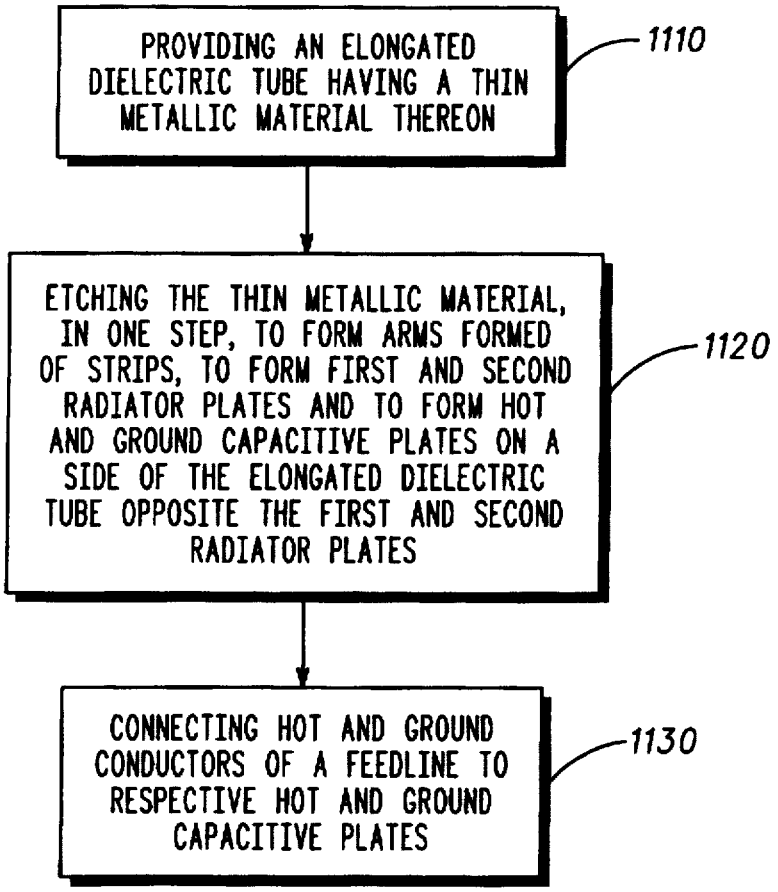
FIG. 8 is a flow chart illustrating a method of manufacture of the integral antenna assembly according to the second approach.

FIG. 8 illustrates a flow chart of a method of manufacture of the integral antenna assembly according to the second approach. In step 1110, an elongated dielectric tube having a thin metallic material thereon is provided. In step 1120, the thin metallic material is etched in one step, to form arms formed of strips, to form first and second radiator plates and to form hot and ground capacitive plates. The hot and ground capacitive plates are formed on a side of the elongated dielectric tube opposite the first and second radiator plate. Thus, only one etching step is required to form both the radiating arms of the antenna and the plates of a matching capacitor. In step 1130, hot and ground leads of a feedline are connected to hot and ground capacitive plates by, for example, only two soldering steps. The present invention improves manufacturability, reliability, and cost. The etching step of the present invention can be performed by chemical etching, laser etching or mechanical etching. In either case, the etching can now be advantageously performed in a single step, thus avoiding multiple piece parts and unnecessary solder joints. The providing of the thin metallic material and the etching can be performed together by shaping the thin metallic material prior to attaching or gluing it to the dielectric tube.

Although the invention has been described and illustrated in the above description and drawings, it is understood that this description is by example only and that numerous changes and modifications can be made by those skilled in the art without departing from the true spirit and scope of the invention.

What is claimed is:

1. An antenna assembly for a radio, comprising:

an elongated dielectric tube having a surface;

an antenna element comprising at least one pair of arms formed of strips of a thin metallic material disposed on the surface of the elongated dielectric tube concentric with a shape of the elongated dielectric tube;

a first radiator plate portion integrally formed of the same thin metallic material as one of the pair of arms disposed on the surface of the elongated dielectric tube;

a second radiator plate portion integrally formed of the same thin metallic material as another of the pair of arms disposed on the surface of the elongated dielectric tube;

a feedline having a hot lead and a ground lead for feeding energy between the antenna assembly and a radio;

a hot capacitive plate electrically connected to the hot lead of the feedline and formed of a thin metallic material disposed on a side of the elongated dielectric tube opposite the first radiator plate portion for capacitive coupling with the first radiator plate portion; and a ground capacitive plate electrically connected to the ground lead of the feedline and formed of a thin metallic material disposed on a side of the elongated dielectric tube opposite the second radiator plate portion for capacitive coupling with the second radiator plate portion; and wherein, a dielectric constant of the elongated dielectric tube, a width of the elongated dielectric tube, a thickness of the elongated dielectric tube, lengths of the arms, an area of the first and second radiator plate portions and an area of the hot and ground capacitive plates are sufficient to match impedances of the feedline and the antenna element.

2. An antenna assembly according to claim 1, wherein the elongated dielectric tube comprises a flange protruding from a feed end of the surface and forming first and second opposite sides of the flange;

wherein the first radiator plate portion and the second radiator plate portion are formed on the first side of the flange; and wherein the hot capacitive plate and the ground capacitive plate are formed on the second side of the flange.

3. An antenna assembly according to claim 2, wherein the flange forms a concentric skirt at the feed end of the elongated dielectric tube.

4. An antenna assembly according to claim 3, wherein the concentric skirt has a width smaller than a width of the elongated dielectric tube.

5. An antenna assembly according to claim 3, wherein the concentric skirt has a width substantially the same as a width of the elongated dielectric tube.

6. An antenna assembly according to claim 2, wherein the elongated dielectric tube is closed by an inner-wall at the feed end.

7. An antenna assembly according to claim 6, wherein the flange forms a pad suspended from the inner-wall of the elongated dielectric tube.

8. An antenna assembly according to claim 7, wherein the pad is radially suspended from the inner-wall of the elongated dielectric tube by a stem.

9. An antenna assembly according to claim 7, wherein the pad suspended from the inner-wall of the elongated dielectric tube is a disc.

10. An antenna assembly according to claim 1, wherein the hot capacitive plate and the ground capacitive plate are formed on an inside surface of the elongated dielectric tube near a feed end.

11. An antenna assembly according to claim 1, wherein the arms comprise two pairs of strips of the thin metallic material having an orthogonal relationship with one another.

12. An antenna assembly according to claim 11, wherein two of the pairs of arms forms two orthogonal loops providing a crossed loop antenna assembly.

13. An antenna assembly according to claim 11, wherein two of the pairs of arms forms two twisted orthogonal loops providing a quadrifilar helix antenna assembly.

14. An antenna assembly according to claim 1, wherein the antenna assembly forms a circularly polarized antenna assembly.

15. An antenna assembly according to claim 1, wherein the feedline is an unbalanced feedline comprising a balun.

16. An antenna assembly according to claim 15, wherein the feedline is coaxial and the ground lead is an outer conductor of the feedline; and wherein the balun comprises a split in the ground conductor of the feedline to form a split sheath balun structure.

17. An antenna assembly according to claim 16, wherein sides of the split are directly connected to one of the hot and ground capacitive plates.

18. An antenna assembly for a radio, comprising:

an elongated dielectric tube having a surface, the tube closed at a feed end;

a circularly polarized antenna element comprising two pairs of arms, each of the pairs comprising strips of a thin metallic material disposed on the surface of the elongated dielectric tube concentric with a shape of the elongated dielectric tube and electrically forming a loop;

a flange protruding from a feed end of the surface of the elongated dielectric tube and forming first and second opposite sides of the flange;

a first radiator plate portion integrally formed of the same thin metallic material as one of the pair of arms and disposed on the surface of the elongated dielectric tube and the first side of the flange;

a second radiator plate portion integrally formed of the same thin metallic material as another of the pair of arms disposed on the surface of the elongated dielectric tube and the first side of the flange;

a feedline having a hot lead and a ground lead for feeding energy between the antenna assembly and a radio;

a hot capacitive plate electrically connected to the hot lead of the feedline and formed of a thin metallic material disposed on the second side of the flange on a side of the elongated dielectric tube opposite the first radiator plate portion for capacitive coupling with the first radiator plate portion; and a ground capacitive plate electrically connected to the ground lead of the feedline and formed of a thin metallic material disposed on the second side of the flange on a side of the elongated dielectric tube opposite the second radiator plate portion for capacitive coupling with the second radiator plate portion; and wherein, a dielectric constant of the elongated dielectric tube, a width of the elongated dielectric tube, a thickness of the elongated dielectric tube, lengths of the arms, an area of the first and second radiator plate portions and an area of the hot and ground capacitive plates are sufficient to match impedances of the feedline and the antenna element.

19. A radio, comprising:

an elongated dielectric tube having a surface;

an antenna element comprising at least one pair of arms formed of strips of a thin metallic material disposed on the surface of the elongated dielectric tube concentric with a shape of the elongated dielectric tube;

a first radiator plate portion integrally formed of the same thin metallic material as one of the pair of arms disposed on the surface of the elongated dielectric tube;

a second radiator plate portion integrally formed of the same thin metallic material as another of the pair of arms disposed on the surface of the elongated dielectric tube;

a feedline having a hot lead and a ground lead for feeding energy between the antenna assembly and a radio;

a hot capacitive plate electrically connected to the hot lead of the feedline and formed of a thin metallic material disposed on a side of the elongated dielectric tube opposite the first radiator plate portion for capacitive coupling with the first radiator plate portion;

a ground capacitive plate electrically connected to the ground lead of the feedline and formed of a thin metallic material disposed on a side of the elongated dielectric tube opposite the second radiator plate portion for capacitive coupling with the second radiator plate portion;

a user interface to the radio; and a radio transceiver operatively coupled between the user interface, the hot lead of the feedline and the ground lead of the feedline; and wherein, a dielectric constant of the elongated dielectric tube, a width of the elongated dielectric tube, a thickness of the elongated dielectric tube, lengths of the arms, an area of the first and second radiator plate portions and an area of the hot and ground capacitive plates are sufficient to match impedances of the feedline and the antenna element.

20. A method of manufacturing an antenna assembly, comprising the steps of:

(a) providing an elongated dielectric tube and a thin metalization on a surface concentric with the shape of the tube;

(b) etching the thin metalization to form, in one etching step, at least one pair of arms of strips of the thin metalization, a first radiator plate portion, a second radiator plate portion, a hot capacitive plate on a side of the elongated dielectric tube opposite the first radiator plate portion and a ground capacitive plate on a side of the elongated dielectric tube opposite the second radiator plate portion, wherein, a dielectric constant of the elongated dielectric tube, a width of the elongated dielectric tube, a thickness of the elongated dielectric tube, length of the arms, an area of the first and second radiator plate portions and an area of the hot and ground capacitive plates are sufficient to match impedance of a feedline and a resulting antenna element;

(c) connecting a hot lead of the feedline to the hot capacitive plate for a capacitive coupling with the first radiator plate portion; and (d) connecting a ground lead of the feedline to the ground capacitive plate for a capacitive coupling with the second radiator plate portion.

* * * * *